United States Patent [19]

Molat

[11] 4,222,571

[45] Sep. 16, 1980

[54] ELECTRICALLY OPERATED BINGO DEVICE FOR SIGHTED AND SIGHT DISADVANTAGED PEOPLE

[76] Inventor: Joseph H. Molat, Stratford 36 C, West Palm Beach, Fla. 33409

[21] Appl. No.: 958,360

[22] Filed: Nov. 3, 1978

[51] Int. Cl.[3] ..... A63F 3/06

[52] U.S. Cl. ..... 273/237; 40/505; 273/281; 273/269

[58] Field of Search ..... 273/280, 269, 237, 238, 273/281, 287; 40/503, 504, 505

[56] References Cited

U.S. PATENT DOCUMENTS

| | | | |
|---|---|---|---|
| 2,464,146 | 3/1949 | Mohler | 273/269 |
| 2,760,619 | 8/1956 | Peak | 273/238 |
| 2,968,881 | 1/1961 | Evans | 40/503 |
| 3,120,657 | 2/1964 | Hooker | 273/237 |
| 3,305,958 | 2/1967 | Price | 40/503 |
| 4,080,596 | 3/1978 | Keck et al. | 273/237 |

FOREIGN PATENT DOCUMENTS

| | | | |
|---|---|---|---|
| 793156 | 4/1958 | United Kingdom | 273/237 |

*Primary Examiner*—Richard C. Pinkham
*Assistant Examiner*—Scott L. Brown
*Attorney, Agent, or Firm*—Clarence A. O'Brien; Harvey B. Jacobson

[57] ABSTRACT

Game board devices to be used as bingo cards are provided with changeable numbering sequences capable of being more readily perceived and remembered by sight handicapped persons. Through switches on the game board card, chance selected numbers may be registered by each player and through parallel circuits produce an audible sound when a winning game is achieved upon closure of those switches corresponding to predetermined patterns on the game board.

11 Claims, 7 Drawing Figures

10
12
14
16
18
2
56
32
40
36
34
23
46
20
22
FREE PLAY
24
26
28
30
B
I
N
G
O
ON
OFF
1
16
31
46
61
2
17
32
47
62
3
18
48
63
4
19
33
49
64
5
20
34
50
65
INFORMATION - THIS CARD
B - 1 - 15
I - 16 - 20
N - 31 - 32 - FREE SPACE - 33-34
G - 46 - 50
O - 61 - 65
INFORMATION - ALL CARDS WITH TOTAL
B - 1 - 15
I - 16 - 30
N - 31 - 42
G - 46 - 60
O - 61 - 75
X
H
V

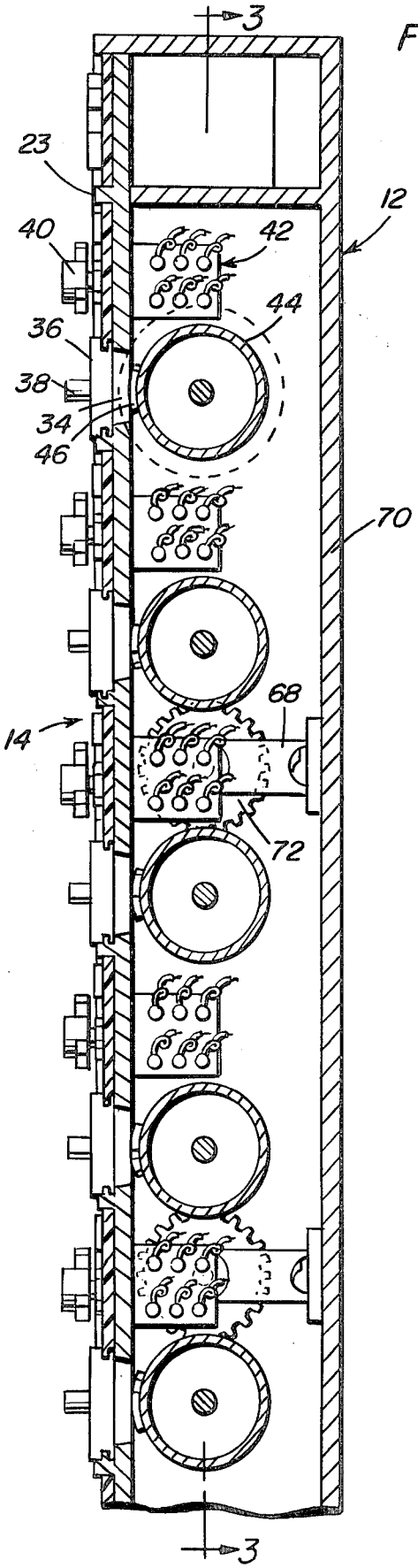
Fig. 2
Fig. 4
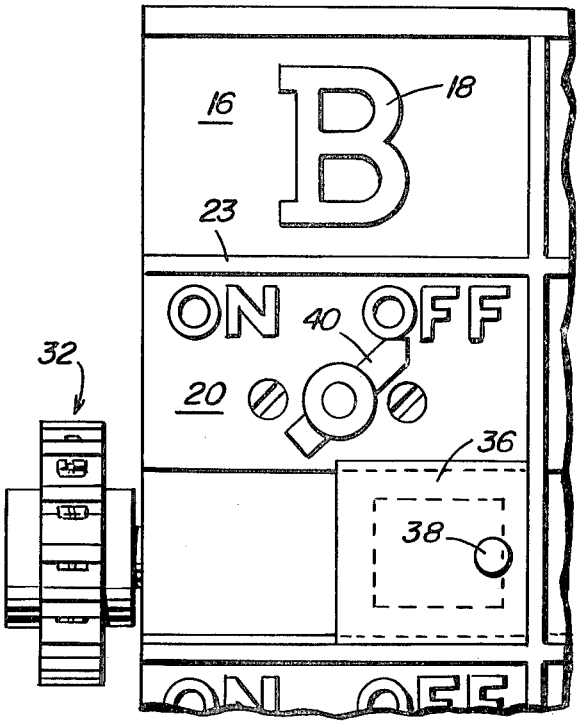
Fig. 5
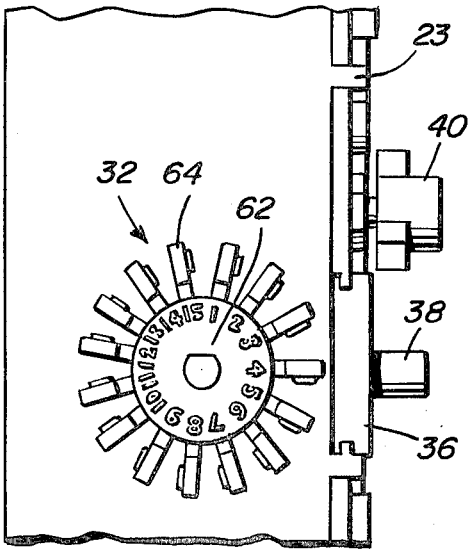

ELECTRICALLY OPERATED BINGO DEVICE FOR SIGHTED AND SIGHT DISADVANTAGED PEOPLE

BACKGROUND OF THE INVENTION

This invention relates to apparatus adapted for the playing of games such as BINGO and in particular to facilitate the participation of sight disadvantaged persons as players of such games.

The concept of adapting games such as BINGO for the blind by use of raised lettering and braille on game boards or cards, is well known as disclosed, for example, in U.S. Pat. No. 2,464,146. Electrically operated BINGO game boards whereby winning games are electrically registered by indicators are also known as disclosed in U.S. Pat. Nos. 2,591,869 and 3,194,560. In the latter type of game board, game pieces are plugged into the board in order to register a called number. The latter type of game boards are, however, unsuitable for sight handicapped persons because of the problems associated with plugging in game pieces and locating plug in zones corresponding to called numbers.

It is therefore an important object of the present invention to provide a BINGO type game board through which winning games are audibly registered and designed to enable game participation of sight handicapped players, blind and sighted players at the same time.

SUMMARY OF THE INVENTION

In accordance with the present invention, a game board is provided for each bingo player, having a display panel on which zone registering switches are mounted so that the player may manually register a called number on a corresponding zone of the game board without placement or insertion of a game piece. A winning game is indicated by an audible indication when the player actuated switches complete one of a plurality of parallel pattern establishing circuits corresponding to different predetermined zone patterns such as columns, rows and crossing diagonals. The zone identifying numbers assigned to each zone are changeable under control of a manual, position indicating wheel assembly fixed through gearing to a plurality of drums having peripherally mounted indicia exposed at each of the zones through window openings on the display panel. The indicia is in the form of visual and touch perceived numbers arranged in sequential order on the drums.

These together with other objects and advantages which will become subsequently apparent reside in the details of construction and operation as more fully hereinafter described and claimed, reference being had to the accompanying drawings forming a part hereof, wherein like numerals refer to like parts throughout. Therefore, this game can be used electrically and non-electrically by use of the slides and pre-determined numbers in sequential order.

BRIEF DESCRIPTION OF THE DRAWINGS

FIG. 2 is an enlarged partial sectional view taken substantially through a plane indicated by section line 2—2 in FIG. 1.

FIG. 4 is an enlarged front elevational view of a portion of the game board shown in FIG. 1.

FIG. 5 is a side elevational view of the portion of the game board shown in FIG. 4.

DETAILED DESCRIPTION OF THE PREFERRED EMBODIMENT

Figure 1:
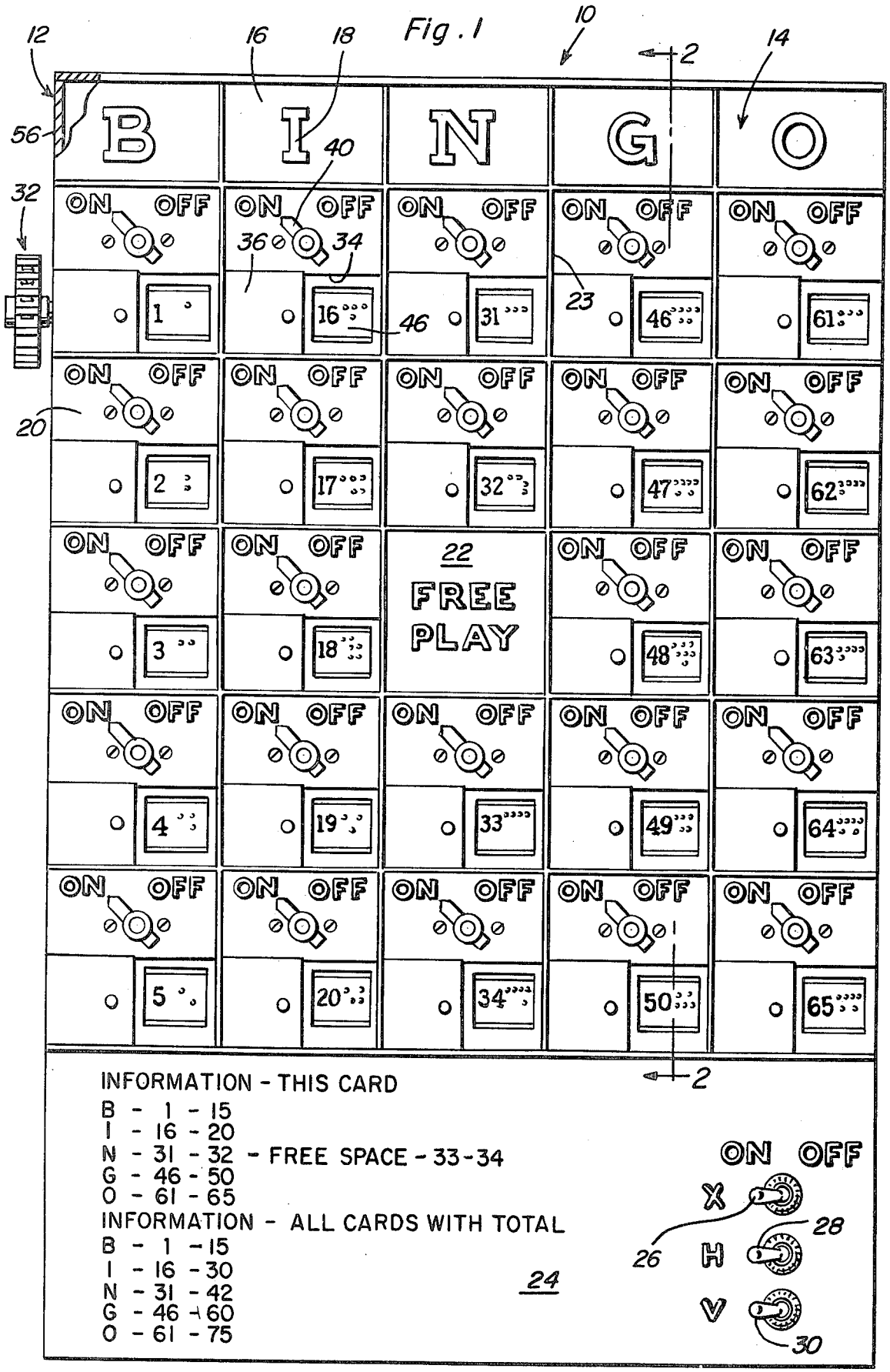
FIG. 1 is a front elevational view of a game board constructed in accordance with the present invention.

Referring now to the drawings in detail, FIG. 1 illustrates one of many game boards 10 serving as BINGO cards and constructed in accordance with the present invention. The game board assembly is of a generally rectangular box-like structure formed by an outer housing on which a front display panel, generally denoted by reference numeral 14 is mounted and adapted to be read by both sighted and sight disadvantaged persons. The housing walls and front panel may be made of any suitable material such as wood, metal and plastics. The front panel 14 is of a design arranged for the playing of the familiar game of "BINGO" with certain modifications as will be explained hereinafter. Thus, a top horizontal portion of the front panel 14 is divided into five sections 16 enclosing raised lettering 18 spelling the word "BINGO.". The panel is divided into twenty-four numbered zones 20 and a central "free play" zone 22 below the top sections 16. The zones 20 and 22 are arranged in columns of five aligned below each lettered section 16 as in the case of any "BINGO" game card. Raised dividers 23 separate the sections 16, 20 and 22 from each other so that they may be readily recognized by sight disadvantaged persons. A bottom portion 24 of the top panel has legend and game information thereon and mounts three game selection switches 26, 28 and 30, respectively, labelled "X," "H" and "V" referring to cross-diagonal, horizontal and vertical row types of game patterns that may be rendered operative or disabled by placing the appropriately labeled selection switch in the "on" or "off" position. The numbering associated with each of the zones 20 may be changed by manual rotation of a side wheel assembly 32 as will be explained in detail hereinafter.

Each of the playing zones 20 is the same except for the associated game number exposed through a window opening 34 as shown in FIG. 1. The opening 34 may be closed by an opaque door 36 having a knob 38 as shown in FIG. 4. The door is slidably mounted on the zone 20 below a manual switch operator 40 adapted to be displaced between "on" and "off" positions labeled by raised lettering. As shown in FIG. 2, each switch operator 40 is connected to a six-terminal register switch 42 enclosed within the housing 12 behind the front panel 14 and above an indicia-bearing drum 44 on which number indicia 46 is peripherally mounted for exposure through the window opening 34. The number indicia includes both visual numbers and corresponding braille for recognition by sight disadvantaged persons.

Figure 3:
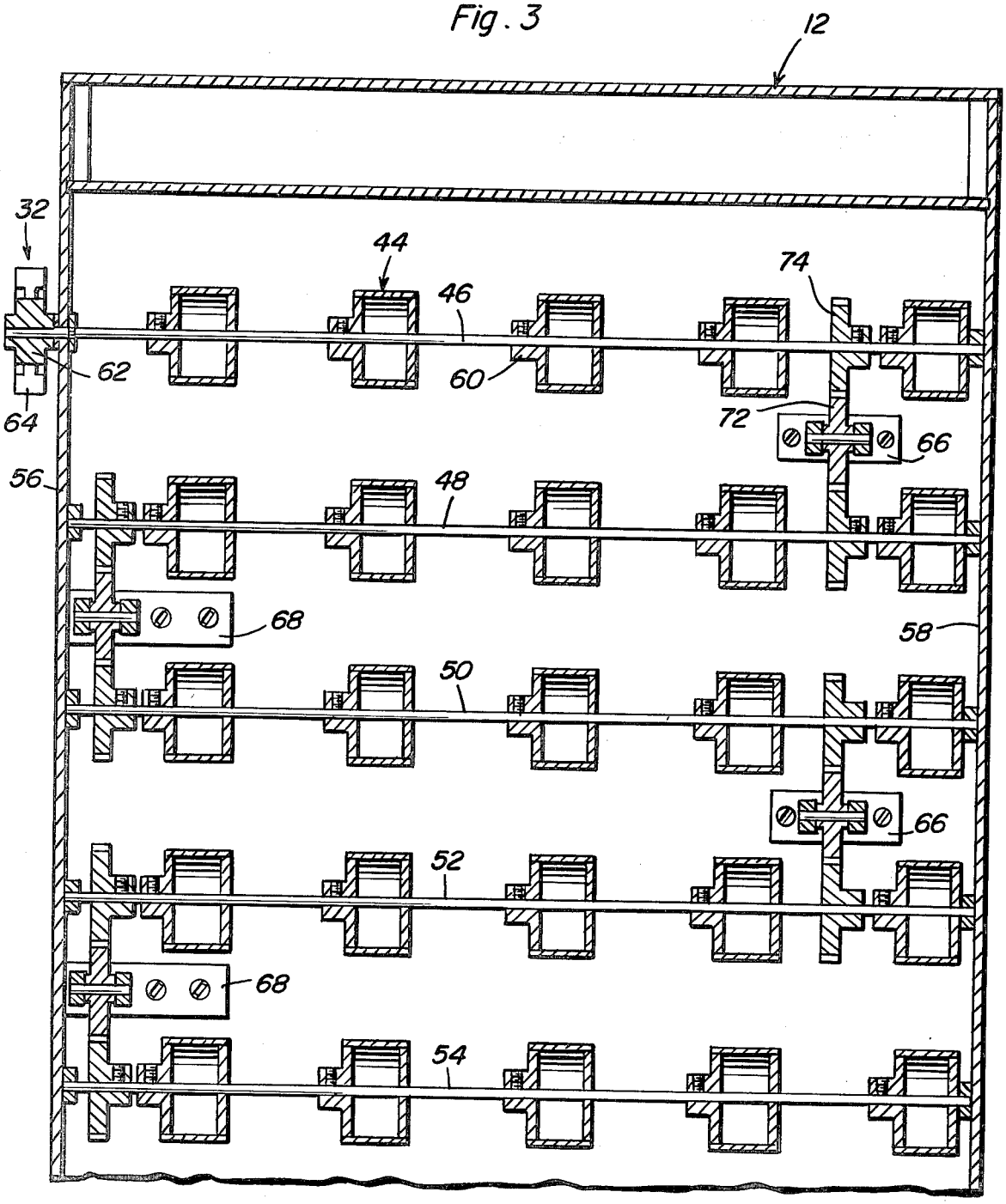
FIG. 3 is a sectional view taken substantially through a plane indicated by section lines 3—3 in FIG. 2.

As shown in FIGS. 2 and 3, the drums 44 are mounted for alignment with the twenty-four openings 34 associated with the playing zones 20 by means of five parallel spaced shafts 46, 48, 50, 52 and 54. The shafts are journaled by spaced bearings attached to the side walls 56 and 58 of the housing 12 and the drum 44 are fixed both axially and rotationally to the shafts by set-screw fastened collars 60. The uppermost shaft 46 is extended through the side wall 56 for attachment to the hub portion 62 of the wheel assemmbly 32. Numbered flag elements 64 extend radially from the hub portion 62 to identify the angular position of the wheel assembly and the five drums 44 rotationally fixed thereto by shaft 46. The angular position of the wheel assembly also determines the angular position of all of the other drums attached to shafts 48, 50, 52 and 54 because they are geared to shaft 46. Thus, bearing brackets 66 and 68 mounted on the back wall 70 of the housing adjacent side walls 58 and 56 rotatably mount gears 72 intermeshed with gears 74 fixed to each of the shafts. All shafts are thereby rotated in the same direction and by the same amount by the wheel assembly 32 in order to simultaneously change the angular positions of all drums 44 and the numbering indicia exposed through the openings 34.

Figure 6:
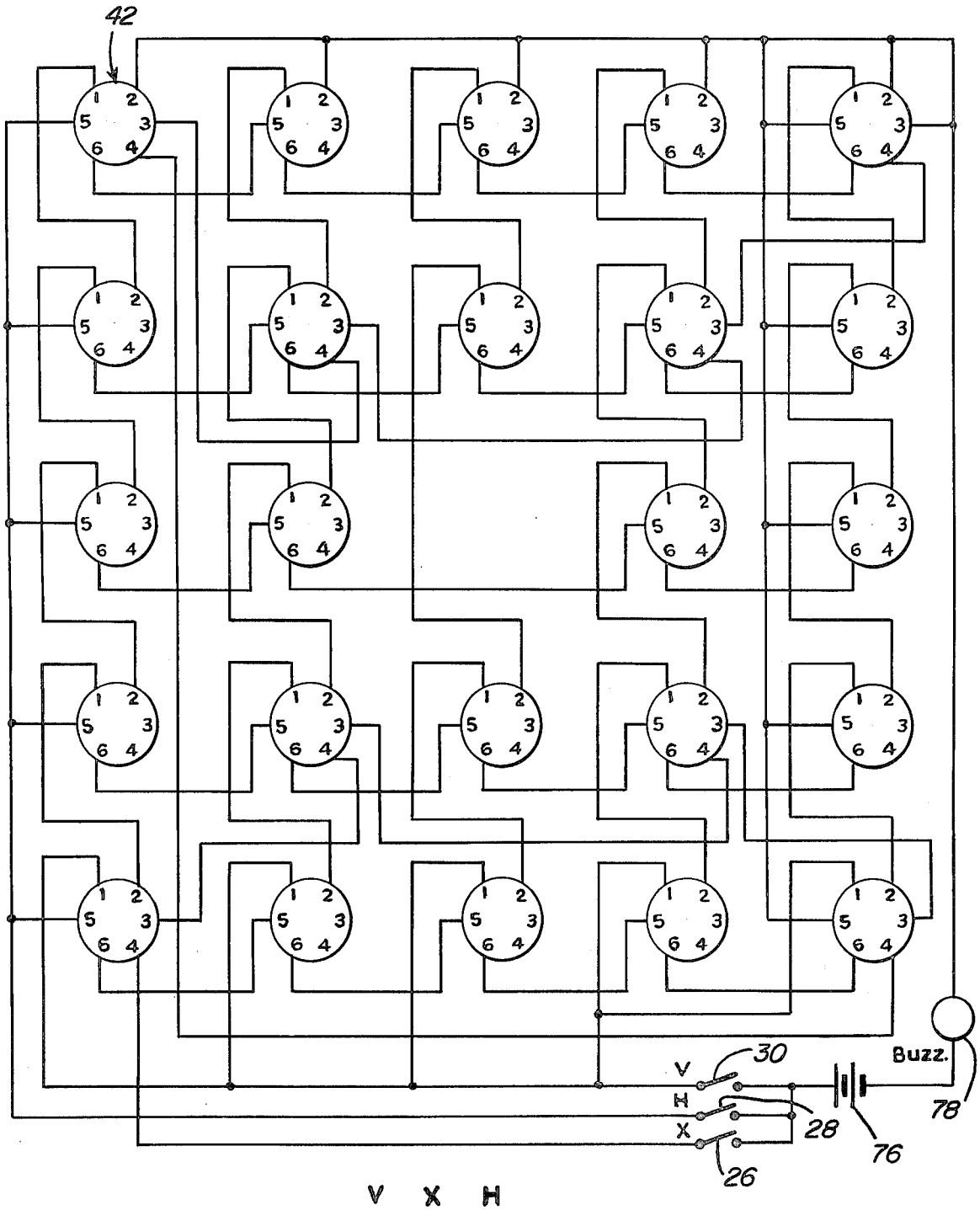
FIG. 6 is an electrical circuit diagram illustrating the wiring associated with the game board shown in FIG. 1.
Figure 7:
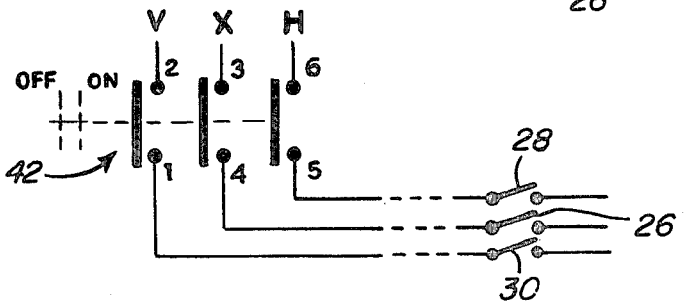
FIG. 7 schematically illustrates one of the register switches associated with the game board of the present invention.

As shown in FIG. 6, the twenty-four register switches 42, respectively, associated with the zones 20 of the front panel, are wired through the selection switches 26, 28 and 30 to a low voltage source, such as battery 76, in order to complete an energizing circuit for an audible indicator device such as buzzer 78 when the player achieves a winning game upon closing of all switches 42 connected in a predetermined pattern associated with a closed one of the game selection switches 26, 28 and 30. As shown in FIG. 7, when a switch 42 is displaced from its "off" or open position to the "on" or active position, terminals 1 and 2, 5 and 6, 4 and 3 are bridged to establish three parallel conductive paths capable of being extended through three parallel circuits by closure of all other switches 42 in any vertical column pattern, in any horizontal row pattern or through a crossing diagonal pattern. It will, however, be noted from FIG. 6, that some of the switches 42 do not have any wiring connected to terminals 3 and 4 since such switches cannot form part of the crossing diagonal circuit. One or more of such three parallel circuits may be completed or disabled by one or more of the game selection switches.

The numbering arrangement associated with each game board assembly 10 may be changed by angular positioning of the wheel assembly 32 as aforementioned. Accordingly, each player may hold the same game-card as herein described, adjusted to a different numbering arrangement fom all other game cards. All of the register switch operators 40 are placed in the "off" position to start the game. On instruction from the game manager, the appropriate game selection switch or switches 26, 28 and 30 may be closed by each player holding a game card. Playing of the game may then proceed in a conventional manner by the game manger selecting and calling out letters and number combinations. Each time the called letter and number combination corresponds to the indicia 46 exposed in one of the zones 20 of a game-card, the player closes the corresponding zone switch 42 through operator 40. When closure of a switch 42 completes a circuit, the buzzer 78 operates to signify a winning game.

The numbering arrangements available for each game card 10 is limited to fifteen, with the numbers in each vertical letter column being exposed on the drums 44 in sequence since a number sequence may be more readily remembered by the sight disadvantaged player. Fifteen angular positions are therefore labeled on the flag elements of the wheel assembly 32 as more clearly seen in FIG. 5.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game board assembly comprising a display panel divided into a plurality of zones having window openings therein, register means mounted on each of said zones for displacement to an active position denoting a plurality of arrangements of the zones in predetermined patterns, a plurality of rotatable drums having indicia exposed at the window openings of said zones of the display panel, means interconnecting said register means for registering the patterns formed by those zones of the display panel at which the pattern denoting means are in the active positions, indicating means connected to the interconnecting means for signifying a winning game in response to registration of at least one of the predetermined patterns, and game selection means connected to the interconnecting means for disabling registration of selected ones of the patterns.

2. The combination of claim 1 wherein each zone of the display panel has a window opening through which the indicia is exposed, and means for preventing exposure of the indicia at any of the window openings.

3. The combinaton of claim 1, wherein said predetermined patterns are comprised of columns, rows and cross diagonal arrangements of said zones on the display panel.

4. The combination of claim 1 including gear means drivingly interconnecting all of said drums for simultaneous rotation, and position indicating wheel means connected to the gear means for angularly adjusting the positions of the drums.

5. A game board assembly comprising a display panel divided into a plurality of zones, register switch means mounted on each of said zones for displacement to an active position establishing a plurality of conductive paths therethrough, indicia means exposed at said zones of the display panel, circuit means interconnecting said register switch means for completing parallel circuits through the conductive paths of the switch means mounted at those zones of the display panel forming predetermined patterns, indicating means connected to the circuit means for registering a winning game in response to completion of at least one of the parallel circuits, and game selection means connected to the circuit means for disabling selected ones of the parallel circuits, each of said zones of the display panel having a window opening through which the indicia means is exposed, and means for inactivating the indicia means at any of the window openings, said indicia means including a plurality of rotatable drums havng peripheral portions aligned with said window openings in the zones of the display panel.

6. The combination of claim 5 including means for changing the indicia means.

7. The combination of claim 5 wherein said indicia changing means includes gear means drivingly interconnecting all of said drums for simultaneous rotation, and position indicating wheel means connected to the gear means for angularly adjusting the position of the drums.

8. The combination of claim 7 wherein said predetermined patterns are comprised of columns, rows and cross diagonal arrangements of said zones on the display panel.

9. A game board comprising a display panel divided into a plurality of zones, each of said zones having a window, movable means exposed through the windows for identifying each of said zones, manually operable means mounted on the display panel at each of said zones for registration of identified zones, means establishing predetermined patterns formed by groups of said registered zones, and indicating means connected to said pattern establishing means for signifying a winning game in response to registration of one of said groups of the identified zones, said movable means including a plurality of drivingly interconnected drums having indicia formed thereon in alignment with the windows.

10. The combination of claim 9 including means for preventing establishment of selected ones of the patterns by the pattern establishing means.

11. The combination of claim 10 including means connected to the movable means for changing the identification of said zones.

* * * * *